United States Patent [19]

Howell et al.

[11] 4,205,582

[45] Jun. 3, 1980

[54] PERCUSSION ENVELOPE GENERATOR

[75] Inventors: Stephen L. Howell; John W. Robinson, both of Jasper, Ind.

[73] Assignee: Kimball International, Inc., Jasper, Ind.

[21] Appl. No.: 13,840

[22] Filed: Feb. 22, 1979

[51] Int. Cl.[2] ..... G10H 1/02; G10H 5/00

[52] U.S. Cl. ..... 84/1.26; 84/1.1; 84/1.13

[58] Field of Search ..... 84/1.1, 1.13, 1.26

[56] References Cited

U.S. PATENT DOCUMENTS

| | | | |
|---|---|---|---|
| 3,180,919 | 4/1965 | Stiefel | 84/1.26 |
| 3,244,790 | 4/1966 | Sharp | 84/1.13 |
| 3,383,453 | 5/1968 | Sharp | 84/1.26 |
| 3,435,123 | 3/1969 | Schrecongost | 84/1.26 |
| 3,565,998 | 2/1971 | Bunger | 84/1.26 |
| 3,565,999 | 2/1971 | Bunger | 84/1.26 |
| 3,602,628 | 8/1971 | Peterson | 84/1.26 |
| 3,626,074 | 12/1971 | Hiyama | 84/1.13 X |
| 3,636,232 | 1/1972 | Hiyama | 84/1.26 X |
| 3,637,915 | 1/1972 | Hirano | 84/1.13 |
| 3,652,775 | 3/1972 | Adachi et al. | 84/1.26 |
| 3,784,718 | 1/1974 | Uchiyama | 84/1.13 |
| 3,821,459 | 6/1974 | Schrecongost | 84/1.13 |
| 3,924,505 | 12/1975 | Schrecongost | 84/1.13 X |
| 3,935,783 | 2/1976 | Machanian et al. | 84/1.1 X |
| 3,952,624 | 4/1976 | Kawakami | 84/1.26 |
| 3,971,284 | 7/1976 | Schreier | 84/1.26 |
| 4,014,238 | 3/1977 | Southard | 84/1.13 |
| 4,067,253 | 1/1978 | Wheelwright et al. | 84/1.1 |
| 4,119,006 | 10/1978 | Whitefield | 84/1.13 |

*Primary Examiner*—S. J. Witkowski

*Attorney, Agent, or Firm*—Albert L. Jeffers; John F. Hoffman

[57] ABSTRACT

A circuit for generating a percussion envelope for use in electronic organs and similar electronic keyboard instruments wherein the envelope has an attack overshoot, a long decay, and a snub decay when the key is released. A velocity sensing feature is included, whereby the force with which the key is struck determines the amount of capacitor discharge, and the voltage remaining on the capacitor is compared with the amplitude of the attack portion of the envelope such that decay is initiated when a compare condition is reached. A second comparator sets the amplitude at which the envelope undergoes transition from a fast decay to the normal long decay. The timing for the attack and three decay portions of the envelope are independently controlled by means of four clock driven electronic gate circuits which incrementally charge and discharge the main timing capacitor. The gate circuits include a pair of serially connected field effect transistors having a capacitor connected at their juncture. The timing control for each individual keyer, including all of the timing capacitors, is contained within a separate LSI chip.

38 Claims, 17 Drawing Figures

HARPSICHORD (1)

HARPSICHORD (2)

PIZZICATO

PIANO (1)

PIANO (2)

PERCUSSION ENVELOPE GENERATOR

BACKGROUND OF THE INVENTION

The present invention relates to an envelope generator and, in particular, to a percussion envelope generator for the percussion keyers of electronic musical instruments of the keyboard variety, such as organs and electronic pianos.

The achievement of a percussive effect, like that produced by conventional percussion instruments such as pianos, harpsichords, xylophones and guitars, in electronic musical instruments such as organs and electronic pianos has long been a requirement. The tones produced by such instruments are generally characterized by a sound which increases rapidly immediately after the key is depressed, undergoes a period of fast decay, and then decays more slowly as long as the key is held. When the key is released, the sound again goes into a fast decay to produce a snub effect.

A serious problem with most prior art techniques for accomplishing this effect is that they employ resistor-capacitor circuits for the timing, which are subject to wide variation due to component tolerances, especially with regard to the timing capacitors. This produces different attack and decay characteristics for the different keys and generally results in an overall effect which is unsatisfactory. Other more elaborate and more expensive methods, such as analog shift register delay for timing, and the plucking of a mechanical reed, have also been used, but are generally not cost effective.

In order to closely simulate the sound of a piano, it is desirable that the instrument be provided with a velocity sensing feature, which allows the organist to play the notes loudly or softly, depending on the force with which the keys are struck. Early prior art has employed devices for sensing the speed with which a magnet attached to the key is moved past a coil, such that the faster the speed, the higher the voltage which is induced into the coil. Also employed are piezoelectric devices, which produce an output voltage that varies with the force with which the device is struck. More recent prior art circuits employ an RC timing network, which detects the time interval for the key switch to travel from one bus to a lower bus. If this time interval is short, which results from the key being struck with greater force, the output volume is high. Similarly, if the time interval is long, which indicates that the key is struck more slowly and with less force, the output volume is low.

A major problem with this type of circuit is that the individual RC timing circuits for the respective keys have different tolerances, thereby causing some keys to have different velocity sensitivity than others. Since a plurality of keys are often depressed simultaneously, as in the playing of a chord, the disparity in component tolerances results in the notes having different degrees of loudness.

SUMMARY OF THE INVENTION

In order to overcome the problems inherent in percussion envelope generators wherein external RC timing circuits are employed, the present invention utilizes separate clock-driven electronic gate circuits for charging and discharging the main timing capacitor for the attack portion of the envelope as well as the three decay portions thereof. The electronic gating circuit, which is very similar to that disclosed in pending Application Ser. No. 892,385 filed Mar. 31, 1978, in the name of John W. Robinson, which is a continuation of Ser. No. 736,256 filed Oct. 27, 1976, now abandoned, comprises a pair of alternately switched field effect transistors, having a capacitor connected to their juncture. As the field effect transistors are rapidly switched, the main timing capacitor is either incrementally charged or discharged through the second capacitor.

Because it is the ratio of the main capacitor to the capacitors connected to the junctures of the respective field effect transistor pairs which determines the timing characteristics, much smaller capacitors can be utilized, thereby enabling MOS integration. When integrated, the capacitors have very narrow and well-defined tolerances, which virtually eliminates any differences in the timing characteristics from one envelope generator to another. Furthermore, the timing characteristics for each portion of the envelope can be individually controlled simply by adjusting the frequencies of the clocks which drive the FET pairs. Thus, a wide variety of percussive effects can be selected by the player, either through tab switch selection or infinitely adjustable controls, thereby enabling the simulation of many percussive-type keyboard instruments, such as piano, harpsichord, xylophone, etc.

Specifically, the present invention contemplates a percussion envelope generator for use in electronic musical instruments of the keyboard variety, which comprises a first capacitor, or other dynamic voltage storage device, connected to the input of the percussion keyer, a first charge transfer device connected to the first capacitor for one of charging or discharging the capacitor at a first rate to produce the attack portion of the envelope when the respective key is actuated, and second and third charge transfer devices for the other of charging or discharging the capacitor at second and third rates respectively to produce first and second consecutive decay portions of the percussion envelope. The charge transfer devices comprise two serially connected first and second variable conductivity control elements forming a branch connected between the capacitor and a terminal having a given voltage level, a second capacitor connected between a base potential and a point located serially between the control elements, and control means for cyclically maintaining the conductivity of the first element at a high level while at the same time maintaining the conductivity of the second element at a low level, and then maintaining the conductivity of the first element at a low level, while at the same time maintaining the conductivity of the second element at a high level, so as to cause the second capacitor to charge through one of the elements and to discharge through the other element, each cycle of the control means such that the first capacitor is either incrementally charged or discharged through the variable conductivity elements. Means are provided for automatically successively rendering the first, second and third charge transfer devices operative to charge or discharge the first capacitor when the respective key of the keyboard is actuated.

The amplitude of the envelope is determined by the velocity with which the respective key is struck so as to simulate the action of a piano. The circuitry for accomplishing this comprises a key switch associated with a key of the keyboard and includes a pair of spaced apart switch terminals, and switch contact means moveable from one of the terminals to the other terminal when the respective key is depressed, the time interval for the contact to move from one terminal to the other being a function of the velocity with which the respective key is struck. Means for either charging or discharging a charge storage circuit, for example, a capacitor, during the time interval results in the voltage present on the charge storage device at the end of the interval being a function of the length of the interval. A comparator, having one of its inputs connected to a reference potential and the other input connected to the charge storage circuit and sensitive to the voltage stored thereby, produces an output signal which activates a circuit for terminating the attack portion of the percussive envelope and initiating the decay portion thereof when a compare condition is detected.

It is an object of the present invention to provide a percussion envelope generator wherein the timing is accomplished by means of clock-driven electronic gate circuits rather than RC networks, thereby virtually eliminating mismatch between the timing circuits for the respective keyers.

Another object of the present invention is to provide a percussion envelope generator wherein a comparator is utilized for detecting the velocity with which the key is depressed so as to control the amplitude of the resulting percussion envelope.

Yet another object of the present invention is to provide a percussion envelope generator having independent control of the attack portion and the three decay portions of the envelope by adjusting the relative frequencies of the clocks driving the electronic charge and discharge circuits for the main timing capacitor.

These and other objects and features of the present invention will become apparent from the detailed description, taken together with the accompanying drawings.

DETAILED DESCRIPTION

Figure 1:
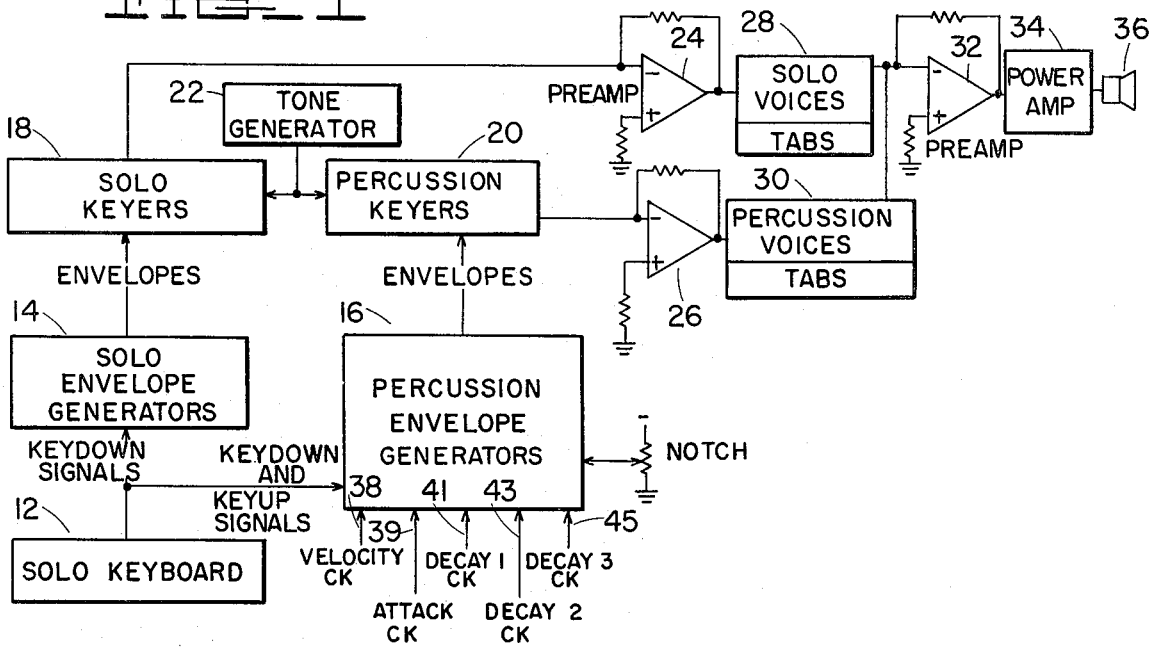
FIG. 1 is schematic block diagram of an electronic organ incorporating the percussion envelope generators of the present invention.

Referring now to FIG. 1, which is a greatly simplified block diagram of an organ including the percussion envelope generators of the present invention, keydown signals from solo keyboard 12 are transmitted to the normal solo envelope generators 14 and also to the percussion envelope generators 16. The solo and percussion envelopes activate solo keyers 18 and percussion keyers 20, respectively, which are also fed by tones from tone generator 22. The keyed tones pass through preamps 24 and 26, tab controlled solo voicing 28 and tab controlled percussion voicing 30, preamp 32 and power amp 34 to speaker 36.

Percussion envelope generators 16 have their timing controlled by a velocity clock signal over line 38, which is associated with key strike velocity sensing circuitry, an attack clock signal over line 39, and three decay clock signals over lines 41, 43 and 45. The exact manner in whcih the percussion envelope generators 16 are controlled will be described in greater detail hereinafter.

Figure 2:
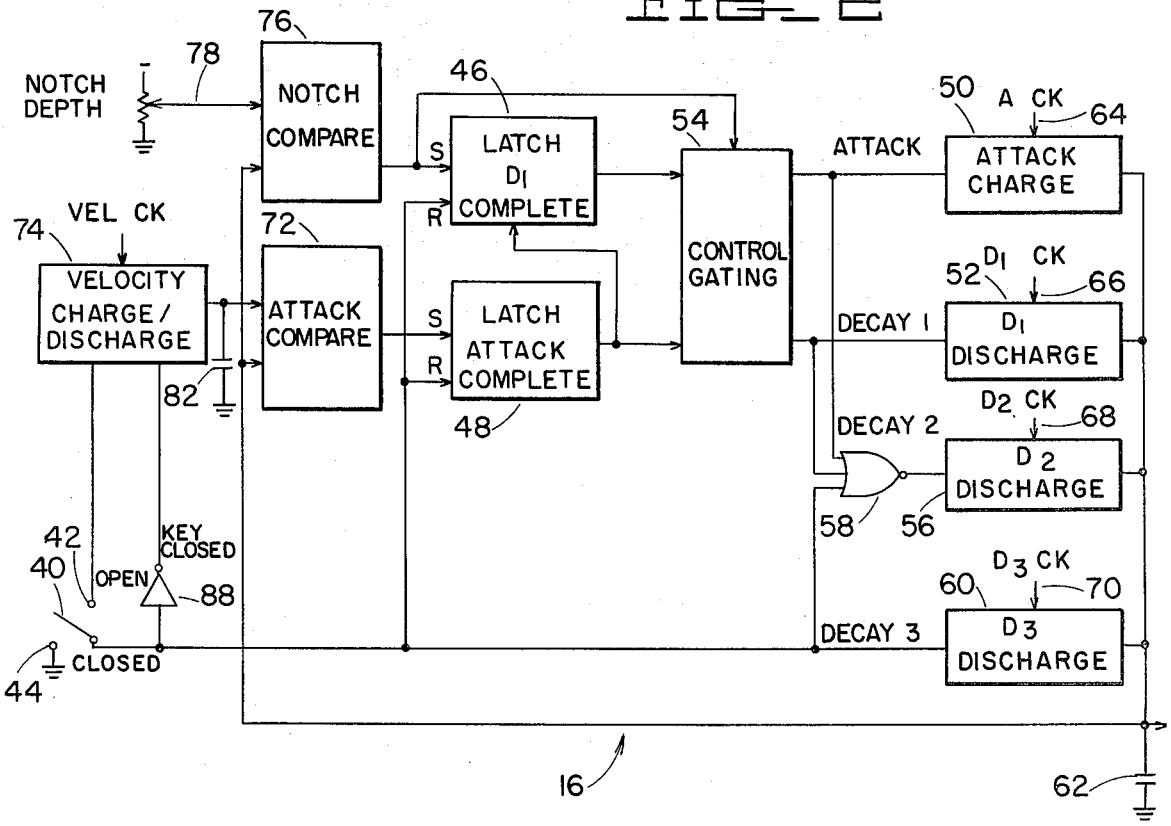
FIG. 2 is a schematic block diagram of one of the percussion envelope generators according to the present invention.

Referring now to FIG. 2, the key switch 40 associated with a key of keyboard 12 is normally in contact with key switch open bus 42 and, when the key is depressed, moves through an intermediate position wherein it contacts neither bus until it contacts the key switch closed bus 44, when the key is fully depressed. When switch 40 is not in contact with bus 44, the Decay 1 latch 46 and the Attack Complete latch 48 are reset, thereby disabling attack charge circuit 50 and Decay 1 discharge circuit 52 through control gating circuit 54, and it disables Decay 2 circuit 56 through gating circuit 54 and NOR gate 58.

The Decay 3 circuit 60, which controls that portion of the percussion envelope (FIG. 3) occurring when the key is released, is enabled when key switch 40 is not in contact with bus 44, and serves to discharge capacitor 62 and hold it discharged. Charge circuit 50 and discharge circuits 52, 56 and 60 are driven by respective clock signals brought in on lines 64, 66, 68 and 70, respectively.

The attack complete latch 48 is set by attack compare circuit 72, which compares the voltage on capacitor 62 with a reference voltage from velocity charge/discharge circuit 74, which is dependent upon the velocity with which switch 40 is moved from the open to the closed position. Latch 46 is set by a signal from notch compare circuit 76, which compares the voltage on capacitor 62 with a manually adjustable voltage on line 78. When latch 48 is set, the attack charge circuit 50 is disabled and the Decay 1 discharge circuit 52 is enabled. When latch 46 is set, the Decay 1 discharge circuit 52 is disabled and the Decay 2 discharge circuit 56, which causes a more gradual discharge of capacitor 62, is enabled. When the key is released, and switch 40 is no longer in contact with bus 44, only the decay 3 discharge circuit 60 is enabled, which rapidly discharges capacitor 62 and holds it discharged.

Figure 3:
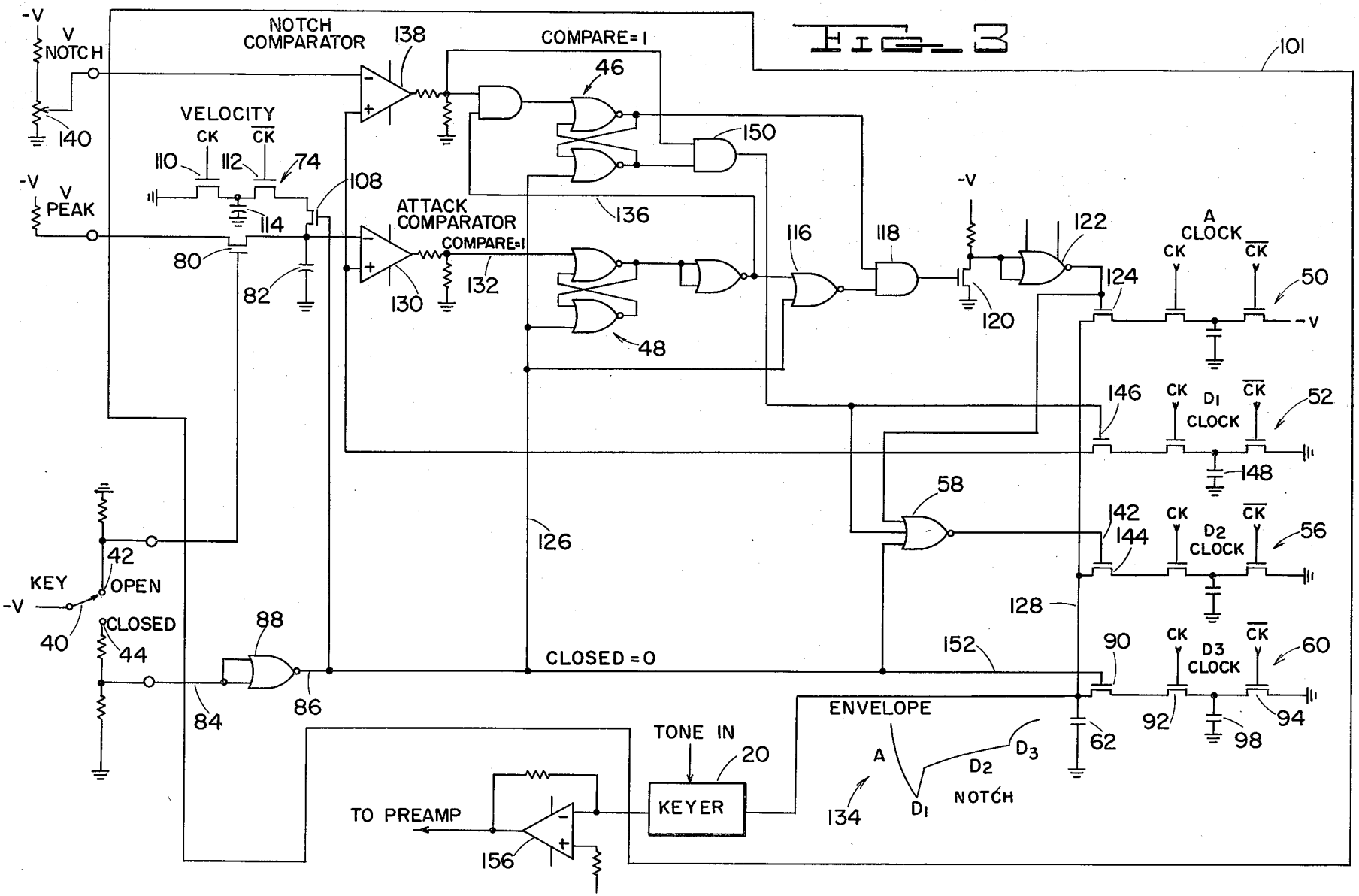
FIG. 3 is a detailed circuit schematic of the percussion envelope generator.

With reference now to FIG. 3, the operation of one of the percussion envelope generators 16 will be described in detail.

With switch 40 in the open position in contact with bus 42, FET 80 will be turned on, which maintains capacitor 82 charged to $V_{peak}$ voltage. At the same time, line 84 is at ground potential, which produces a logic 1 on line 86 at the output of inverter 88. This resets latches 46 and 48 and, due to the use of negative logic, turns on FET 90. This enables the D3 discharge circuit 60 to fully discharge capacitor 62 and hold it discharged.

Figure 5:
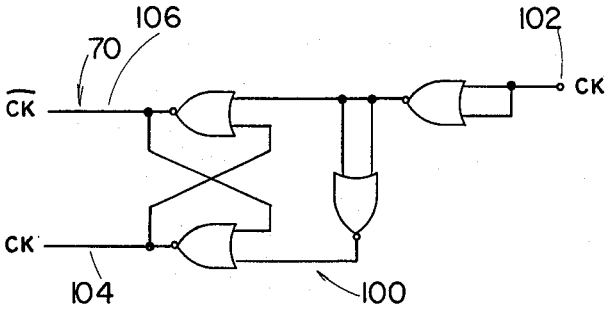
FIG. 5 is a schematic of one of the input clocks.

Discharge circuit 60 comprises a pair of serially connected FETs 92 and 94, with one terminal of FET 94 connected to ground potential. Capacitor 98 is connected to a point serially between FETs 92 and 94 and ground potential. FET 92 is controlled by the clock pulse from RS clock driver 100 (FIG. 5), which is an internal clock driver on the MOS LSI chip which carries nearly all of the FIG. 3 circuitry. Clock driver 100 is driven by a CLOCK pulse train on input terminal 102 and produces a CLOCK output pulse train on output terminal 104 and a $\overline{\text{CLOCK}}$ pulse train on output line 106. Returning now to FIG. 3, FET 94 is driven by the $\overline{\text{CLOCK}}$ pulse train, which is 180° out of phase with the CLOCK pulse train controlling FET 92.

As mentioned previously, this type of charge/discharge circuit is disclosed in pending Application Ser. No.892,385, filed Mar. 31, 1978. When FET 90 is turned on and FETs 92 and 94 are driven into alternate states of conduction by clock 100, capacitor 62 will be incrementally discharged towards the ground potential on the terminal of FET 94. Assuming that at the first instant of time, FET 92 is turned on and FET 94 is turned off, capacitor 62 will begin to discharge through FETs 90 and 92 into capacitor 98, which is at ground potential. At the next instant of time when FET 92 is turned off and FET 94 is turned on, capacitor 62 will cease discharging due to the high resistance of FET 92, and capacitor 98, which at this point carries a small amount of charge, will begin to discharge through FET 94 toward ground potential. At the next instant of time, with FET 92 again turned on and FET 94 turned off, capacitor 62 will discharge further into capacitor 98. As the conductivity levels of FETs 92 and 94 continue to oscillate, the voltage on capacitors 62 and 98 will gradually discharge toward ground potential. The time interval required for the voltage on capacitor 62 to discharge fully is determined by the frequency of the clock signal produced by clock 100 and by the ratio of the values of capacitors 62 and 98.

The fact that the discharge time is dependent upon the ratio of the capacitors 62 and 98 is of the utmost importance because it permits the use of very small value capacitors, which are suitable for large scale integration. By integrating the capacitors 62 and 98, MOS technology may be employed which produces capacitors having very well-defined and narrow tolerances so that the capacitor pairs for each of the envelope generators 16 will be nearly identical thereby ensuring identical response characteristics for each of the keys of the keyboard 12.

After a short interval of time, capacitor 62 will be fully discharged and will be held discharged as FETs 92 and 94 continue to be driven.

When the key is just being depressed, switch 40 will leave bus 42 and FET 80 will be turned off, thereby preventing further charging of capacitor 82. At this time, due to the fact that FET 108 is turned on, capacitor 82 will be discharged by the velocity discharge circuit 74 comprising FETs 110 and 112 and capacitor 114. This circuit functions identically to Decay 3 discharge circuit 60, which was described above.

When switch 40 finally touches bus 44, FET 108 will be turned off and capacitor 82 will cease discharging, and is effectively isolated from the charge/discharge circuit 74.

NOR gate 116 has, until this time, disabled AND gate 118 which, in turn, has turned off FET 120. Inverter 122 has maintained FET 124 turned off, which prevents attack charge circuit 50 from charging capacitor 62. It should be noted that attack charge circuit 50 and decay discharge circuits 52 and 56 function identically to discharge circuit 60 described above, except that circuit 50 charges capacitor 62 rather than discharging it.

Now that key 40 has contacted bus 44, the logic 0 signal on line 126 will turn on FET 124 thereby causing capacitor 62 to be charged toward the -V voltage over line 128. When the voltage on capacitor 62 reaches the stored voltage on capacitor 82, comparator 130 will produce a compare output signal on line 132, which sets latch 48. It should be noted that the voltage on capacitor 82 is a function of the time it takes for switch 40 to move from bus 42 to bus 44 and, therefore, the voltage level on capacitor 62 which will flip comparator 130 is a direct function of the velocity with which the key is depressed. For example, if the key is depressed very slowly, capacitor 82 will discharge to a greater degree so that the compare voltage for comparator 130 will be at a relatively low level.

Setting latch 48 turns off FET 124 so that the charging of capacitor 62 ceases. The level at which this occurs determines the maximum amplitude for the percussion envelope 134, which is the highest voltage end point for the negative going attack portion "A".

Setting latch 48 will set latch 46 over line 136 if the notch comparator 138 has flipped. Notch comparator 138 will flip if the stored voltage on capacitor 62 is larger than the voltage on the $V_{notch}$ potentiometer 140. With latch 46 set and comparator 138 in its flipped condition, the Decay $D_1$ will begin, which is a high slope, rapidly decaying portion of the percussion envelope 134 characteristic of the overshoot produced when the key of a conventional piano is struck. Decay $D_1$ will be completed when notch comparator 138 returns to its original state as the voltage on capacitor 62 decays out. If the key is still being held so that switch 40 is in contact with bus 44, logic 000 at the inputs of NOR gate 58 will produce a logic 1 at the gate terminal 142 of FET 144 thereby turning it on. Previously, FET 146 was turned on and capacitor 62 was being discharged at the rate produced by the $D_1$ clock frequency for $D_1$ discharge circuit 52 and the ratio of capacitors 62 and 148. With FET 146 being turned off by the disabling of AND gate 150 and the turning on of FET 144, capacitor 62 will now be discharged by discharge circuit 56, which is typically driven at a lower frequency than discharge circuit 52 so that the slope of the $D_2$ portion of the percussion envelope 134 is substantially lower. This simulates the envelope which is produced when a conventional piano key is struck and held depressed.

The Decay 2 discharge circuit 56 will be allowed to completely discharge capacitor 62 unless the key is released and switch 40 moves out of contact with bus 44. If the key is released, NOR gate 58 will turn off FET 144 and the logic 1 signal on line 152 will turn on FET 90 so as to rapidly discharge capacitor 62. This, also, is characteristic of the sound produced by a conventional piano when the key is released prior to complete decay of the tone. In order to produce a percussion envelope 134 having different slopes for the respective portions, attack circuit 50 and a discharge circuits 52, 56 and 60 are driven by clock drivers such as 100 having diverse frequencies.

The voltage on capacitor 62 is fed to the control input of keyer 20, which is also fed by tone generator 22. The output of keyer 20 passes through operational amplifier 156 to preamp 26. Similar percussion envelope generators 16 are provided for each key of the keyboard 12 for which a percussion capability is desired. The entire circuit illustrated in FIG. 3 is contained on a large scale integrated circuit chip, with the exception of potentiometer 140, switch 40, operational amplifier 156, and buses 42 and 44. Preferably, clocks 100 are also contained on the same chip.

Figure 4A:
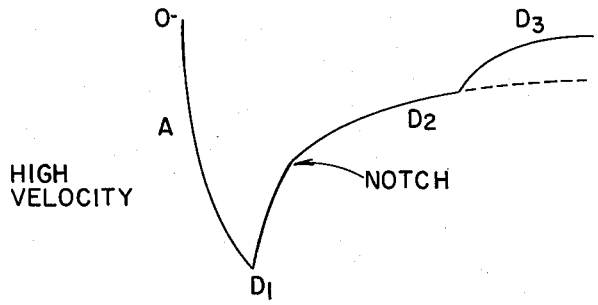
FIGS. 4A, 4B and 4C are percussion envelopes produced by depressing the key at three different velocities.
Figure 4B:
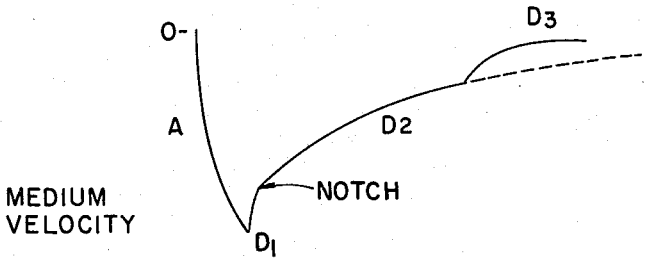
Figure 4C:
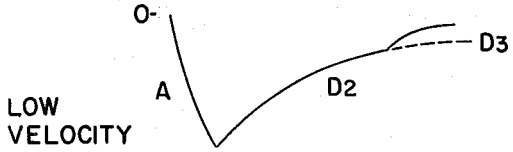

FIG. 4A illustrates the percussion envelope which would be obtained by depressing the key forcefully and with a high velocity. As will be seen, this results in a high degree of overshoot as evidenced by the lower position of the notch, which is the point at which the slope of the decay curve undergoes transition. This results in a sharp percussive sound. If the key is struck with a medium velocity, the overall amplitude of the envelope will be less, as illustrated in FIG. 4B. Additionally, there will be less overshoot so that the notch is located closer to the peak amplitude. If the key is pressed very lightly with low velocity, notch comparator 138 will never flip and there will be no high slope $D_1$ decay portion, as illustrated in FIG. 4C.

Figure 6A:
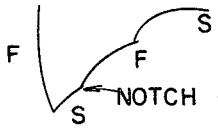
FIGS. 6A–6E are representative percussion envelopes produced by the present invention in order to simulate several percussion instruments.
Figure 6B:
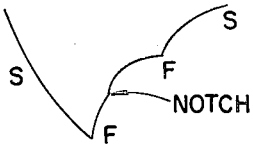

The envelopes illustrated in FIGS. 6A–6E are characteristic of those produced by the instruments noted. In FIG. 6A, for example, a harpsichord sound is produced by driving attack circuit 50 with a high frequency clock signal so that a fast attack is produced (denoted "F"). The $D_1$ decay and $D_3$ decay circuits 52 and 60 are driven by lower frequency clock signals so that the decays in these portions will be slower (denoted "S"). The $D_2$ circuit 56 will be driven by a higher frequency signal, thereby producing a fast $D_2$ decay. FIG. 6B also illustrates an envelope representative of a harpsichord sound, except that the $D_1$ decay is faster than that of the envelope illustrated in FIG. 6A and the attack is somewhat slower.

Figure 6C:
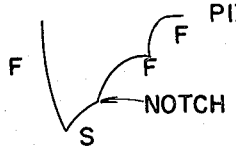
Figure 6D:
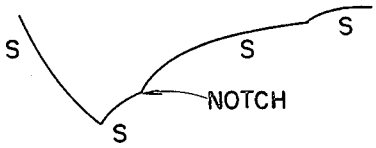
Figure 6E:
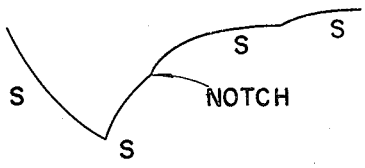

To produce a pizzicato sound, as illustrated in FIG. 6C, the attack, $D_2$, and $D_3$ portions occur rapidly so that the sound is very abrupt and percussive. The wave forms in FIGS. 6D and 6E are representative of the percussion envelopes for simulating piano sounds.

Figure 7:
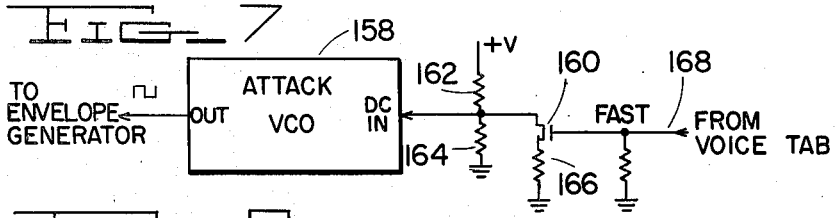
FIG. 7 is a schematic of a preset control for setting one of the timing characteristics for the percussion generator.
Figure 8:
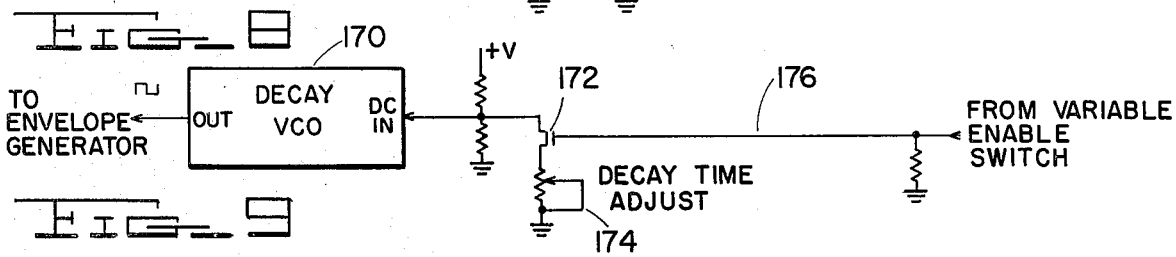
FIG. 8 is an adjustable preset control for setting one of the timing characteristics of the percussion generator.
Figure 9:
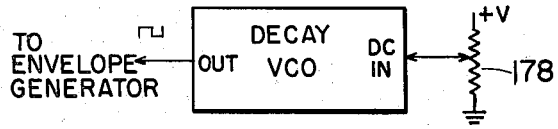
FIG. 9 is an infinitely adjustable control for adjusting one of the timing characteristics for the percussion envelope generator.

FIGS. 7, 8 and 9 show exemplary arrangements for controlling the attack or decay times for the various portions of envelope 134. In FIG. 7, a voltage controlled oscillator 158 drives the attack clock 100 at one of two rates depending on whether or not FET 160 is turned on. This is accomplished by means of the voltage divider comprising resistors 162, 164 and 166 and the control signal on line 168 from an appropriate tab switch (not shown).

In FIG. 8, the frequency of VCO 170 is preset when FET 172 is turned off, but may be infinitely varied by the performer through potentiometer 174 when FET 172 is turned on by an appropriate control signal on line 176.

The arrangement in FIG. 9 results in an infinite adjustment capability by virtue of potentiometer 178.

Figure 11:
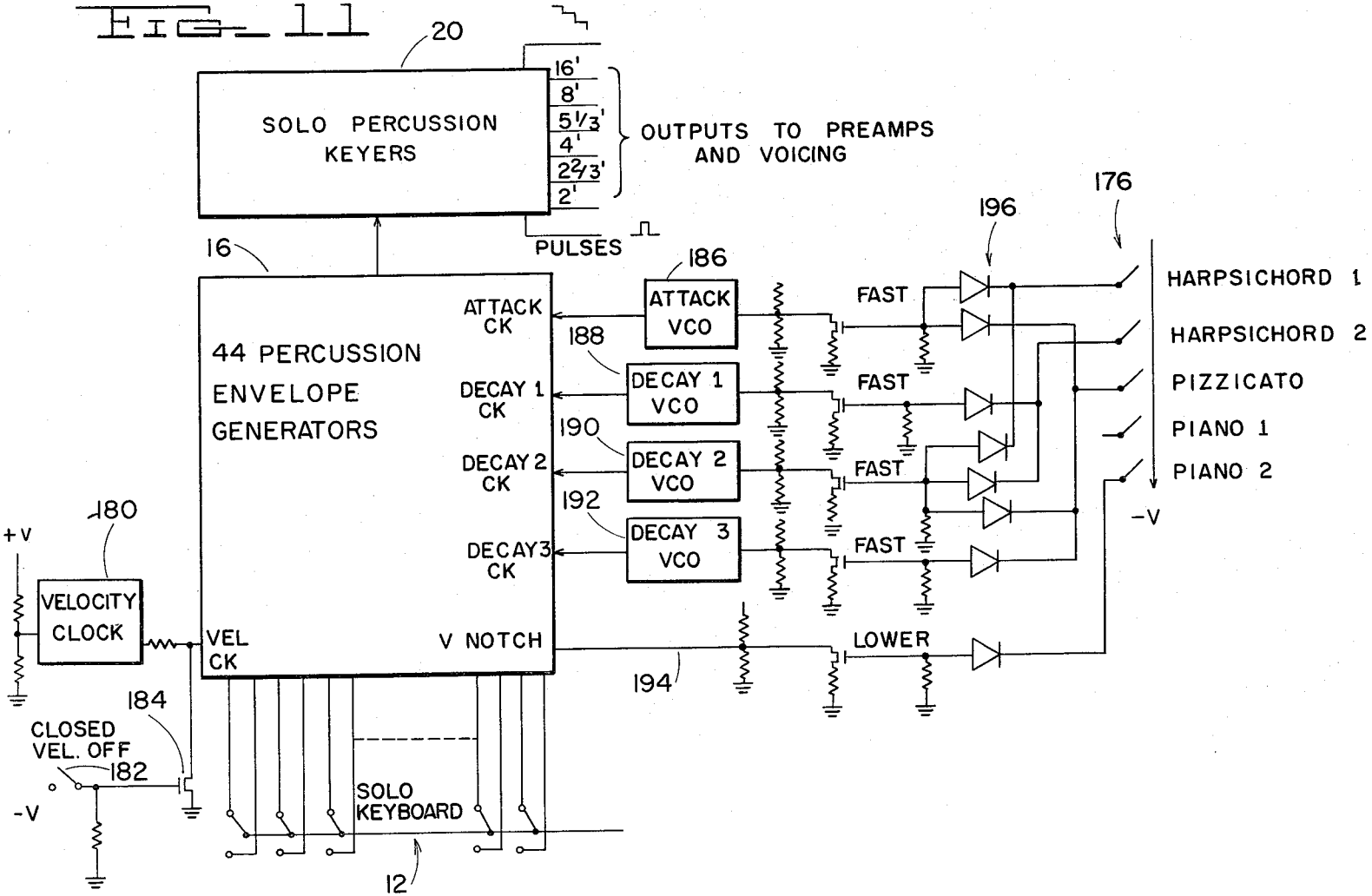
FIG. 11 is a schematic diagram of the percussion system including a bank of tab switches for selecting the timing characteristics.

The arrangement illustrated in FIG. 11 permits a number of preset percussion envelopes to be selected by the performer depending upon which of tab switches 176 is closed. Velocity clock 180 drives the velocity charge/discharge circuit 74 contained within block 116, and may be shunted to ground by closing switch 182 thereby turning on FET 184. Block 116 contains forty-four percussion envelope generators corresponding to the forty-four keys of the solo manual 12, which generators are driven by a common attack VCO 186, and common Decay 1, Decay 2 and Decay 3 VCOs 188, 190 and 192. The $V_{notch}$ level is set for all of the envelope generators 16 over line 194. The VCOs 186, 188, 190 and 192 are driven at various combinations of fast and slow rates by virtue of the logic 196 between them and tab switches 176. Logic 196 will produce the wave forms illustrated in FIGS. 6A–6E for the closure of the respective tab switches 176. Obviously, the number of presets which can be provided is virtually limitless and can be accomplished by extemely simple external logic. This is in contrast to conventional systems wherein the different attack and decay characteristics must be selected by switching external capacitors and resistors in and out, with the inherent problems of matching.

Figure 10:
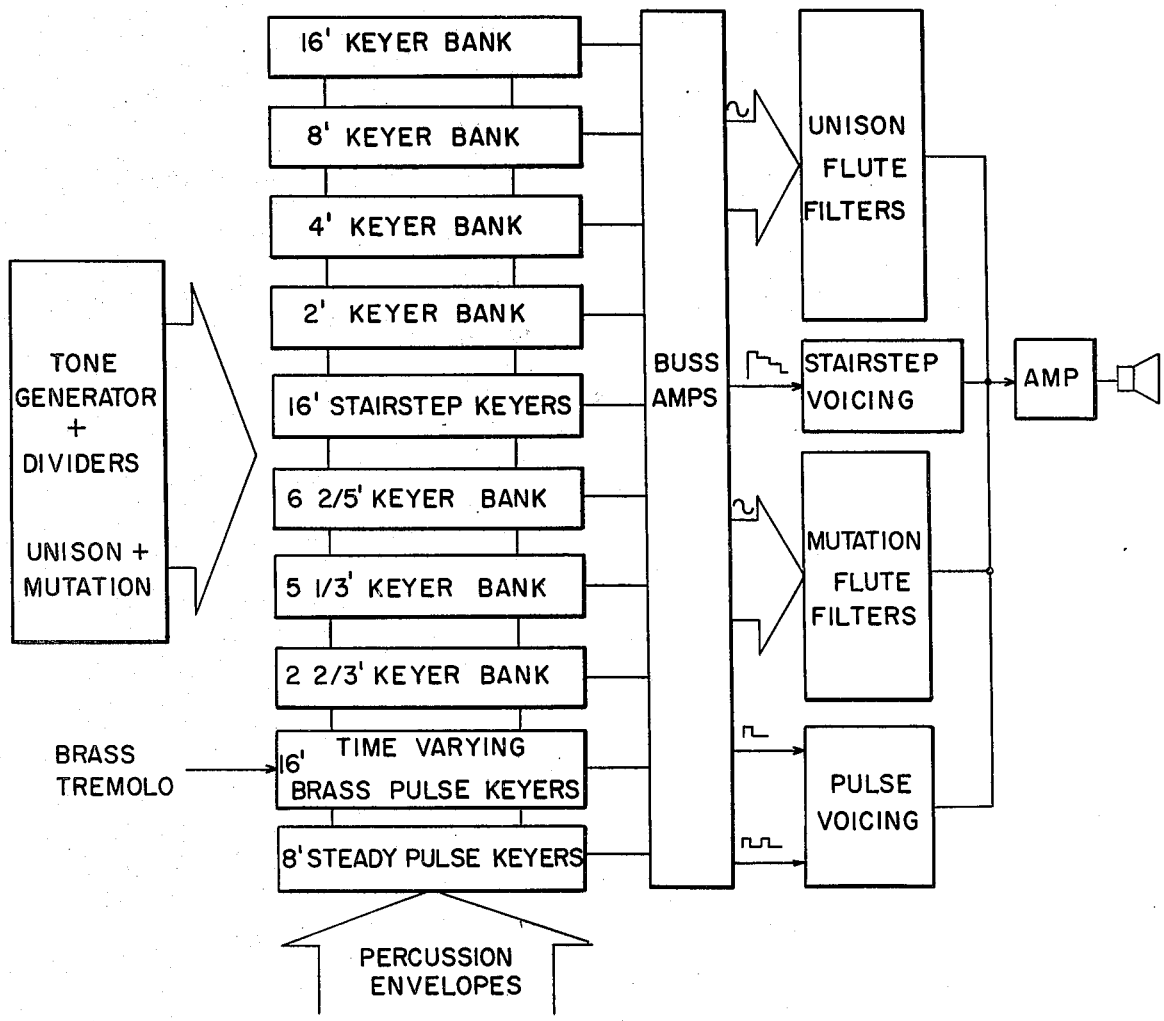
FIG. 10 is a block diagram of the solo percussion keyer bank.

FIG. 10 is a block diagram of the solo percussion keyer bank and is an example of the types of keyers which could be controlled by the percussion envelopes.

While this invention has been described as having a preferred design, it will be understood that it is capable of further modification. This application is, therefore, intendedto cover any variations, uses, or adaptations of the invention following the general principles thereof and including such departures from the present disclosure as come within known or customary practice in the art to which this invention pertains and fall within the limits of the appended claims.

What is claimed is:

1. An electronic musical instrument comprising:

a keyboard, tone generating means for producing a plurality of tones, output circuitry, percussion envelope generating means responsive to the depression of a key of the keyboard for producing a percussion keying envelope having a transient attack portion of one of either increasing or decreasing amplitude and a transient decay portion of the other of increasing or decreasing amplitude, said envelope decaying out after a given interval of time even though the key remains depressed, means for controlling the peak amplitude of said envelope by clocking said envelope generating means at a given frequency and by sensing the velocity with which the key of the keyboard is depressed, the envelope peak amplitude being proportional to said given frequency and to the velocity with which the key is depressed, and keying means interposed between said tone generating means and said output circuitry and having an input connected to receive said keying envelope for coupling one of the tones produced by said tone generating means to said output circuitry wherein the transient amplitude of the coupled tone is proportional to said keying envelope.

2. The electronic musical instrument of claim 1 wherein said means for controlling includes a capacitor which is one of incrementally charged or discharged by a train of clock pulses.

3. The electronic musical instrument of claim 2 wherein said keyboard comprises a plurality of key switches each associated with a different individual key of said keyboard, each switch including a pair of spaced apart switch terminals, and switch contact means movable from one of said switch terminals to the other when the respective individual key is depressed, the time interval for said contact means to move between said terminals being a function of the velocity with which said individual key is struck, and wherein said means for controlling one of charges or discharges said capacitor only during said time interval.

4. The electronic musical instrument of claim 2 wherein said keyboard comprises a plurality of key switches each associated with a different individual key of said keyboard, each switch including a pair of spaced apart switch terminals, and switch contact means movable from one of said switch terminals to the other when the respective individual key is depressed, the time interval for said contact means to move between said terminals being a function of the velocity with which said individual key is struck, and said means for controlling controls the peak amplitude of said envelope in response to said time interval.

5. An electronic musical instrument comprising:

a keyboard, tone generating means for producing a plurality of tones, output circuitry, percussion envelope generating means responsive to the depression of a key of the keyboard for producing a percussion keying envelope having a transient attack portion of one of either increasing or decreasing amplitude and a transient decay portion of the other of increasing or decreasing amplitude, said envelope decaying out after a given interval of time even though the key remains depressed, means for controlling the rate of change of slope of said envelope by clocking said envelope generating means at at least one given frequency, the rate of change of slope being proportional to said given frequency, and keying means interposed between said tone generating means and said output circuitry and having an input connected to receive said keying envelope for coupling one of the tones produced by said tone generating means to said output circuitry wherein the transient amplitude of the coupled tone is proportional to said keying envelope.

6. The electronic musical instrument of claim 5 wherein said means for controlling clocks said envelope generator means by a second frequency wherein the rate of change of slope of said attack portion and the rate of change of slope of said decay portion are proportional to said one given frequency and said second frequency, respectively.

7. The electronic musical instrument of claim 5 wherein said envelope decay portion comprises a plurality of consecutive decay segments and said means for controlling clocks said envelope generator means by a plurality of frequencies wherein the rate of change of slope of said attack portion and said decay segments are proportional to said frequencies, respectively.

8. The electronic musical instrument of claim 7 including adjustable voltage input means to said envelope generator for controlling the duration of at least one of said decay segments.

9. The electronic musical instrument of claim 7 including a plurality of preset player selected control means for adjusting said frequencies to thereby control the shape of said envelope so as to simulate a plurality of percussion instruments.

10. The electronic musical instrument of claim 6 including player controlled means for adjusting said frequencies to thereby control the attack and decay portions of the envelopes.

11. In an electronic musical instrument having a keyboard, a tone generator, output circuitry, and a keyer having a control input and interposed between the tone generator and the output circuitry, the improvement being a percussion envelope generator for said keyer comprising:

a charge storage device connected to the control input of said keyer, first charge transfer means for one of charging or discharging said charge storage device to produce an attack portion of the percussion envelope when a key of the keyboard is actuated, second and third charge transfer means for the other of charging or discharging said charge storage device at diverse rates to produce first and second consecutive decay portions, respectively, of said envelope, a first comparator having one of its inputs connected to a first reference potential and its other input connected to said charge storage circuit, means connected to the output of said first comparator for terminating the attack portion of said envelope and initiating the first decay portion thereof when a compare condition output signal is produced by said first comparator, a second comparator having one of its inputs connected to a second reference potential and its other input connected to said charge storage circuit, and means connected to the output of said second comparator for terminating the first decay portion of said envelope and initiating the second decay portion thereof when a compare condition output signal is produced by said second comparator.

12. The envelope generator of claim 11 associated with a particular key of the keyboard, wherein said first reference potential is dependent upon the velocity with which the key is depressed.

13. The envelope generator of claim 12 wherein said second reference potential is manually adjustable by the player.

14. The envelope generator of claim 11 wherein said charge storage device comprises a capacitor.

15. The envelope generator of claim 11 wherein said percussion envelope generator is associated with a particular key of the keyboard, and including means for discharging said charge storage device at a third rate when the key is released.

16. The envelope generator of claim 11 including player controlled tab switch means for adjusting the attack and decay rates of said envelope.

17. The envelope generator of claim 16 including player controlled tab switch means for adjusting said second reference potential.

18. The envelope generator of claim 11 wherein said charge storage device comprises a capacitor and said first, second and third charge transfer means comprise respective clock cycled electronic gate means for incrementally charging or discharging said capacitor.

19. The envelope generator of claim 18 including player controlled tab switch means for adjusting the rate at which said gate means are switched so as to control the charge or discharge rate of said capacitor.

20. The envelope generator of claim 19 wherein the rates at which said gate means are switched are controlled independently of one another.

21. In an electronic musical instrument including a keyboard with playing keys, and means for generating a keyer actuating percussive envelope having an attack portion and a decay portion, the improvement being a circuit for controlling the amplitude of the percussive envelope comprising:

a key switch associated with a key of the keyboard and including a pair of spaced apart switch terminals, and switch contact means moveable from one of said terminals to the other terminal when the respective key is depressed, the time interval for said contact means to move from one terminal to the other being a function of the velocity with which the respective key is struck, a charge storage circuit, charge means for one of charging or discharging said charge storage circuit during said time interval such that the voltage increase or decrease, respectively, is a function of said time interval, a comparator having one of its inputs connected to a reference potential and the other input connected to said charge storage circuit and sensitive to the voltage stored therein, and means connected to the output of said comparator for terminating the attack portion of said percussive envelope and initiating the decay portion thereof when a compare condition output signal is produced by said comparator.

22. The circuit of claim 21 wherein said charge storage circuit comprises a capacitor charged or discharged by said charge means, and said charge means comprises: two serially connected first and second variable conductivity control elements forming a branch connected between said capacitor and a terminal having a given voltage level, a second capacitor connected to a point located serially between said control elements, and a control means for cyclically maintaining the conductivity of said first element at a high level while at the same time maintaining the conductivity of said second element at a low level and then maintaining the conductivity of said first element at a low level while at the same time maintaining the conductivity of said second element at a high level so as to cause said first capacitor to incrementally charge or discharge through said variable conductivity elements and said second capacitor.

23. The circuit of claim 22 wherein said first capacitor is discharged during said time interval from a fully charged condition to a partially charged condition.

24. The circuit of claim 21 wherein said percussive envelope has a first decay portion and a consecutive second decay portion, said decay portions having diverse slopes, and including second comparator means for comparing the amplitude of said first decay portion with a second reference potential and for terminating said first decay portion and initiating said second decay portion when a compare condition is reached.

25. The circuit of claim 24 including player controlled means for adjusting said reference potential.

26. The circuit of claim 21 including a plurality of said means for generating a percussive envelope and a plurality of circuits for controlling the amplitudes of the percussive envelopes associated with respective keys of the keyboard.

27. In an electronic musical instrument having a keyboard, a tone generator, output circuitry, and a keyer interposed between the tone generator and output circuitry, the improvement being a percussion envelope generator responsive to the actuation of a key of the keyboard comprising:

first capacitor means connected to the input of said keyer, first charge transfer means connected to said first capacitor means for one of charging or discharging said capacitor means at a first rate to produce an attack portion of the percussion envelope when said key is actuated, second and third charge transfer means for the other of charging or discharging said capacitor means at second and third rates respectively to produce first and second consecutive decay portions of the percussion envelope, said first, second and third charge transfer means comprising: two serially connected first and second variable conductivity control elements forming a branch connected between said first capacitor means and a terminal having a given voltage level, second capacitor means connected to a point located serially between said control elements, and a control means for cyclically maintaining the conductivity of said first element at a high level while at the same time maintaining the conductivity of said second element at a low level and then maintaining the conductivity of said first element at a low level while at the same time maintaining the conductivity of said second element at a high level to cause said second capacitor means to charge through one of said elements and to discharge through the other of said elements each cycle of said control means so that said first capacitor means is incrementally charged or discharged through said variable conductivity elements, and means for automatically successively rendering said first, second and third charge transfer means operative to charge or discharge said first capacitor means when a key of the keyboard is actuated.

28. In an electronic musical instrument having a keyboard, a tone generator, output circuitry, a keyer interposed between the tone generator and output circuitry, the improvement being a percussion envelope generator responsive to the actuation of a key of the keyboard comprising:

first capacitor means connected to the input of said keyer, first charge transfer means connected to said first capacitor means for one of charging or discharging said capacitor means at a first rate to produce an attack portion of the percussion envelope when said key is actuated, second and third charge transfer means for the other of charging or discharging said first capacitor means at second and third rates respectively to produce first and second consecutive decay portions of the percussion envelope, each of said first, second and third charge transfer means comprising: two serially connected first and second variable conductivity control elements forming a branch connected between said first capacitor means and a terminal having a given voltage level, second capacitor means connected at a point located serially between said control elements, and control means for cyclically maintaining the conductivity of said first element at a high level while at the same time maintaining the conductivity of said second element at a low level and then maintaining the conductivity of said first element at a low level while at the same time maintaining the conductivity of said second element at a high level to cause said second capacitor means to charge through one of said elements and discharge through the other of said elements each cycle of said control means so that said first capacitor means is incrementally charged or discharged through said variable conductivity elements, and sequencing means for automatically successively rendering said first, second and third charge transfer means operative to charge or discharge said first capacitor means when a key of the keyboard is actuated.

29. The envelope generator of claim 28 including a fourth said charge transfer means for the other of charging or discharging said first capacitor means at a fourth rate to produce a third decay portion of the percussion envelope.

30. The envelope generator of claim 29 wherein said sequencing means comprises means for rendering said fourth charge transfer means operative and the remaining charge transfer means inoperative when the actuated key is released.

31. The envelope generator of claim 28 wherein said decay portions have diverse rates of decay.

32. The envelope generator of claim 28 wherein said sequencing means comprises first comparator means for comparing the voltage level on said first capacitor means with a first reference potential and rendering said second charge transfer means operative and said first charge transfer means inoperative when the voltage on said first capacitor means is substantially equal to said first reference potential.

33. The envelope generator of claim 32 wherein said sequencing means comprises second comparator means for comparing the voltage level on said first capacitor means with a second reference potential and rendering said third charge transfer means operative and said second charge transfer means inoperative when the voltage on said first capacitor means is substantially equal to said second reference potential.

34. The envelope generator of claim 28 wherein said sequencing means comprises second comparator means for comparing the voltage level on said first capacitor means with a second reference potential and rendering said third charge transfer means operative and said second charge transfer means inoperative when the voltage on said first capacitor means is substantially equal to said second reference potential.

35. The envelope generator of claim 34 including means for adjusting said second reference potential.

36. The envelope generator of claim 28 including key strike velocity sensing circuitry comprising:

a plurality of key switches, each associated with a different individual key of said keyboard, each switch including a pair of spaced apart switch terminals, and switch contact means moveable from one of said switch terminals to the other switch terminal when the respective individual key is depressed, the time interval for said contact means to move between said terminals being a function of the velocity with which said individual key is struck, and amplitude means for sensing said time interval and setting the amplitude of said percussion envelope in response to said time interval.

37. The envelope generator of claim 36 wherein said velocity sensing circuitry includes a charging circuit which charges to a voltage level dependent on said time interval, and comparator means having one of its inputs connected to said charging circuit and its other input connected to a reference potential for producing a control signal for limiting the attack portion of said percussion envelope when a compare condition is present at its inputs.

38. The envelope generator of claim 28 including a plurality of player controlled tab switch means for controlling the rates at which the respective variable conductivity elements of said first, second and third charge transfer means are cycled between high conductivity and low conductivity levels to thereby vary the respective slopes of the attack and decay portions of the percussive envelope.

* * * * *